US006952183B2

(12) United States Patent
Yuanzhu

(10) Patent No.: US 6,952,183 B2
(45) Date of Patent: Oct. 4, 2005

(54) CIRCULARLY-POLARIZED-WAVE PATCH ANTENNA WHICH CAN BE USED IN A WIDE FREQUENCY BAND

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/615,113

(22) Filed: Jul. 8, 2003

(65) Prior Publication Data

US 2004/0012527 A1 Jan. 22, 2004

(30) Foreign Application Priority Data

Jul. 16, 2002 (JP) ..... 2002-207079

(51) Int. Cl.[7] ..... H01Q 1/38
(52) U.S. Cl. ..... 343/700 MS; 342/372
(58) Field of Search ..... 343/700 MS, 846, 343/853; 342/372, 375

(56) References Cited

U.S. PATENT DOCUMENTS 4,749,996 A * 6/1988 Tresselt ..... 343/700 MS
4,973,972 A * 11/1990 Huang ..... 343/700 MS
5,166,693 A * 11/1992 Nishikawa et al. ..... 342/422
5,940,030 A * 8/1999 Hampel et al. ..... 342/372
5,995,047 A 11/1999 Joel et al. ..... 343/700 MS
6,054,906 A 4/2000 Kim ..... 333/124
6,184,828 B1 * 2/2001 Shoki ..... 342/372

FOREIGN PATENT DOCUMENTS

| | | |
|---|---|---|
| DE | 100 08 602 A1 | 6/2001 |
| JP | 07-070911 | 7/1995 |
| WO | WO 02/05451 A1 | 1/2002 |

OTHER PUBLICATIONS

Search Report dated Aug. 4, 2003 for European Patent Application No. EP 03 25 3862.

* cited by examiner

*Primary Examiner*—Tan Ho
(74) *Attorney, Agent, or Firm*—Brinks Hofer Gilson & Lione

(57) ABSTRACT

A circularly-polarized-wave patch antenna includes a main body having a patch electrode provided with two feeding points and a circuit for generating a phase difference of 90° between signals supplied to the feeding points. A Wilkinson distribution circuit is provided between the 90°-phase-difference generating circuit and a coaxial cable (feeder line) so as to improve a reflection characteristic. The patch antenna includes two feeding points, and thus a favorable axial ratio characteristic can be obtained in a wide band. Also, a favorable reflection characteristic can be obtained in a wide band because of the Wilkinson distribution circuit. Accordingly, the patch antenna can be used in a wider frequency band.

10 Claims, 2 Drawing Sheets

CIRCULARLY-POLARIZED-WAVE PATCH ANTENNA WHICH CAN BE USED IN A WIDE FREQUENCY BAND

BACKGROUND OF THE INVENTION

1. Field of the Invention

The present invention relates to a circularly-polarized-wave patch antenna. In particular, the present invention relates to a configuration of a feeder circuit thereof.

2. Description of the Related Art

In recent years, patch antennas, which are compact and thin circularly-polarized-wave antenna, have been becoming widespread. In this type of patch antenna, a main body of the antenna is formed by providing a patch electrode and a ground electrode on both principal surfaces of a dielectric substrate. In this configuration, a predetermined high-frequency signal is supplied to a feeding point of the patch electrode so as to excite two orthogonal modes whose phases are different by 90°. Accordingly, a circularly polarized radio wave is radiated.

A single-point feeding method or a two-point feeding method can be adopted in a circularly-polarized-wave patch antenna. In general, a single-point feeding method is adopted because of its simple configuration. In the circularly-polarized-wave patch antenna using a single-point feeding method, a degenerate isolation element (perturbation element), such as a notch, is loaded on the patch electrode, and only one feeding point is provided on the patch electrode. One end of a feeding pin, which extends through the dielectric substrate, is connected to the feeding point, and the other end of the feeding pin is connected to a feeder line, such as a coaxial cable. In the patch antenna of a single-point feeding type configured in the above-described manner, by adequately adjusting an area ratio of the patch electrode to the degenerate isolation element and the position of the feeding point, a phase difference of 90° can be generated between two orthogonal modes, having an equal amplitude and a different resonance length. Accordingly, the patch antenna can be operated as a circularly-polarized-wave antenna.

However, in the circularly-polarized-wave patch antenna using the single-point feeding method, a band of resonance-frequency for generating a phase difference of 90° between the two orthogonal modes is narrow. Therefore, a bandwidth in which a satisfactory axial ratio characteristic required for the circularly-polarized-wave antenna can be obtained, that is, a bandwidth in which the axial ratio of an elliptically polarized wave is under a permissible value, is quite narrow. Accordingly, a favorable axial ratio characteristic cannot be obtained in a wide band.

On the other hand, in a patch antenna using the two-point feeding method, a patch electrode is circular or square-shaped and a degenerate isolation element is not loaded thereon. Two signals whose phases are different by 90° are supplied to two feeding points provided on the patch electrode. A 90°-phase-difference circuit is provided between the input port of a feeder circuit and the patch antenna. With this configuration, a phase of one signal supplied to one of the feeding points of the patch antenna is always delayed by 90° with respect to a phase of another signal supplied to the other feeding point. Accordingly, the two orthogonal modes of the patch electrode are excited with a phase difference of 90°, and thus the patch antenna can be operated as a circularly-polarized-wave antenna. In the patch antenna using the two-point feeding method, signals whose phases are different from each other by 90° are supplied to the two feeding points so as to excite the two orthogonal modes. As a result, a favorable axial ratio characteristic can be obtained over a wide frequency band.

As described above, a favorable axial ratio characteristic can be obtained in a wide band by adopting a circularly-polarized-wave patch antenna including two feeding points. However, in a known patch antenna of a two-point feeding type, it is not easy to supply electric power to the two feeding points of the patch electrode over a wide frequency band without reflection. Further, since reflection of signal waves is more likely to increase due to the limited frequency band of the patch antenna itself, a favorable reflection characteristic cannot be obtained in a wide band. This is because isolation of a pair of transmission lines of the 90°-phase-difference circuit connected to the patch electrode is difficult to ensure.

SUMMARY OF THE INVENTION

The present invention has been made in view of the state of the known art, and it is an object of the present invention to provide a circularly-polarized-wave patch antenna which can be used in a wide frequency band by realizing a favorable axial ratio characteristic and reflection characteristic in a wide band.

In order to achieve the above-described object, a patch antenna of the present invention includes a main body having a dielectric substrate in which a patch electrode is provided on one principal surface thereof and a ground electrode is provided on another principal surface thereof, two feeding points being provided in the patch electrode; a 90°-phase-difference circuit for generating a phase difference of 90° between high-frequency signals supplied to the two feeding points through a pair of output terminals connected to the feeding points; and a Wilkinson distribution circuit including a pair of output terminals connected to the 90°-phase-difference circuit. An input terminal of the Wilkinson distribution circuit is connected to a feeder line so that the main body radiates a circularly polarized radio wave.

By connecting the 90°-phase-difference circuit to the two feeding points of the patch electrode, a favorable axial ratio characteristic can be obtained in a wide band in the patch antenna. Further, the Wilkinson distribution circuit is provided between the 90°-phase-difference circuit and the coaxial cable serving as a feeder line. Therefore, even if reflection is occurred at the patch electrode, this reflection is absorbed by a resistor of the Wilkinson distribution circuit through the 90°-phase-difference circuit, so that the electric power supplied from the feeder line can be evenly distributed to the feeding points of the patch electrode in a wide frequency band without reflection. As a result, reflection of a signal wave can be significantly reduced, and thus a favorable reflection characteristic can be obtained in a wider band. Accordingly, a circularlypolarized-wave patch antenna, in which an axial ratio characteristic and a reflection characteristic are favorable over a wide frequency band, can be obtained.

The Wilkinson distribution circuit includes a junction; two parallel-connected line conductors connected to the junction, each line conductor having an electric length of $\lambda/4$ and a characteristic impedance of $\sqrt{2\times Z1\times Z2}$, wherein Z1 is an input impedance of the Wilkinson distribution circuit, Z2 is an input impedance of the main body, and $\lambda$ is a wavelength of the high-frequency signal on a transmission line; and a resistor whose both ends are connected between the 90°-phase-difference circuit and the line conductors, the resistance of the resistor being 2×Z2. In general, since the characteristic impedance of the coaxial cable serving as a feeder line is about 50 Ω, the input impedance of the Wilkinson distribution circuit is 50 Ω, the characteristic impedance of each of the line conductors is about 70 Ω, and the resistance of the resistor is about 100 Ω.

In the patch antenna having such a feeder circuit, the 90°-phase-difference circuit and the Wilkinson distribution circuit are provided on a lower surface of a circuit board, which is fixed to a lower surface of the ground electrode of the main body in a laminating manner, upper ends of two feeding pins which extend through the dielectric substrate and the circuit board are connected to the feeding points, and lower ends of the two feeding pins are connected to the output terminals of the 90°-phase-difference circuit. With this configuration, the main body and the circuit board are integrated, so that a compact patch antenna which can be used in a wide band can be preferably obtained. In this case, the dielectric substrate of the main body and the circuit board used for the feeder circuit may be included in a multilayer substrate. Also, instead of using the two feeding pins, two microstrip lines may be connected to the patch electrode for performing feeding. In this configuration, by providing the 90°-phase-difference circuit and the Wilkinson distribution circuit between the microstrip lines and the feeder line, the patch antenna can be used in a wider band.

DESCRIPTION OF THE PREFERRED EMBODIMENT

Figure 1:
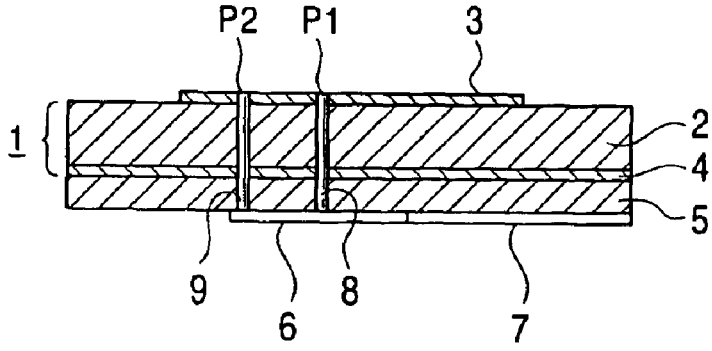
FIG. 1 is a cross-sectional view of a patch antenna according to an embodiment of the present invention.

Hereinafter, an embodiment of the present invention will be described with reference to the above listed figures.

The patch antenna shown in the above listed FIGS. 1, 2, 3, and 4, includes a main body 1 having a dielectric substrate 2; a patch electrode 3 provided on an upper surface of the dielectric substrate 2; and a ground electrode 4 formed on an entire lower surface of the dielectric substrate 2. Further, a circuit board 5 is fixed to a lower surface of the ground electrode 4 of the main body 1 in a laminating manner. Also, a 90°-phase-difference circuit 6 and a Wilkinson distribution circuit 7 are provided on a lower surface of the circuit board 5.

Two feeding points P1 and P2 are provided in the patch electrode 3 of the main body 1. These feeding points P1 and P2 are defined by the upper ends of two feeding pins 8 and 9, the upper ends being soldered to predetermined positions of the patch electrode 3. As shown in FIG. 1, the feeding pins 8 and 9 extend through the dielectric substrate 2 and the circuit board 5. The lower ends of the feeding pins 8 and 9 are connected to different output terminals of the 90°-phase-difference circuit 6. In the embodiment, the dielectric substrate 2 is square-shaped, each edge thereof being about 28 mm, and the patch electrode 3 is also square-shaped, each edge thereof being about 16 mm, when viewed in a plan view.

Figure 2:
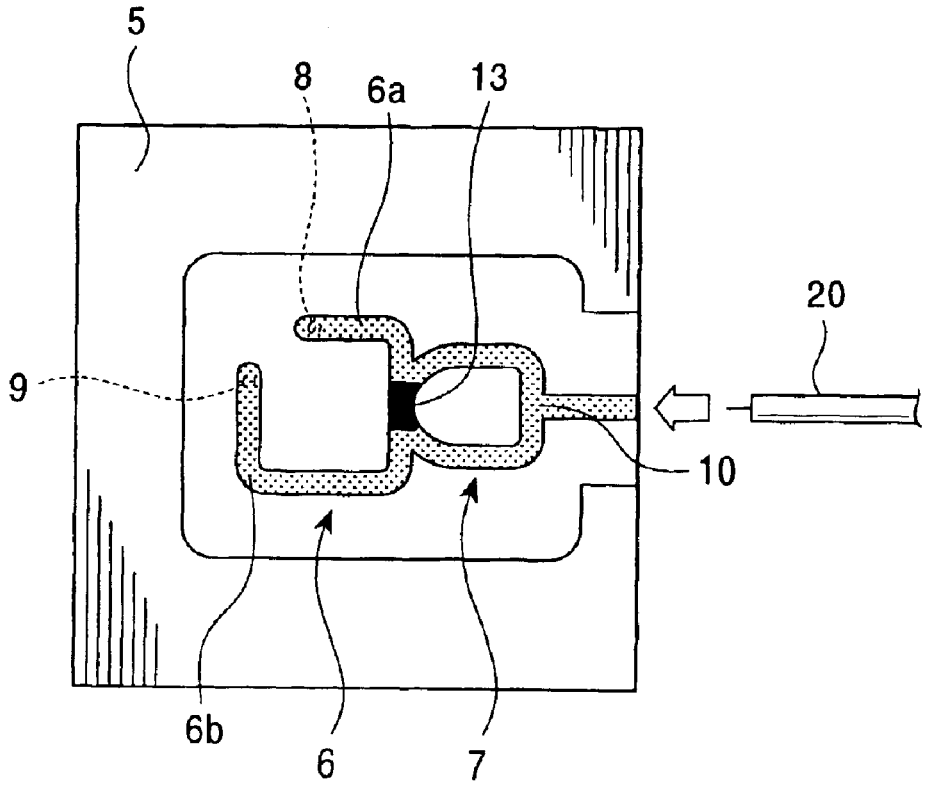
FIG. 2 is a bottom view of the patch antenna.
Figure 3:
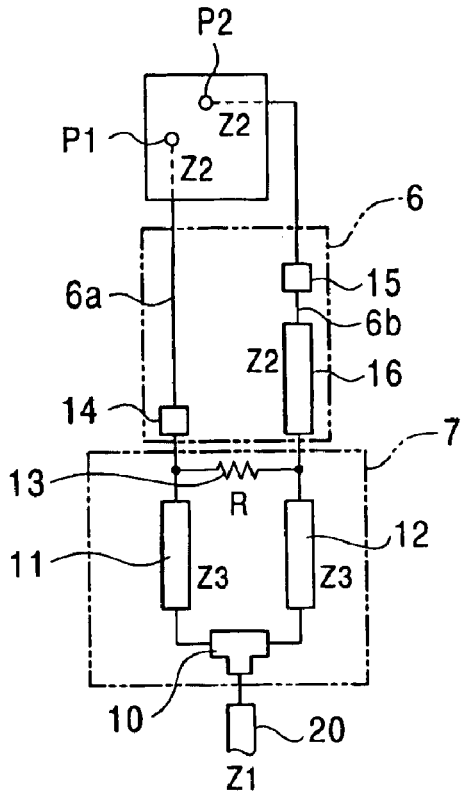
FIG. 3 shows the configuration of a feeder circuit of the patch antenna.
Figure 4:
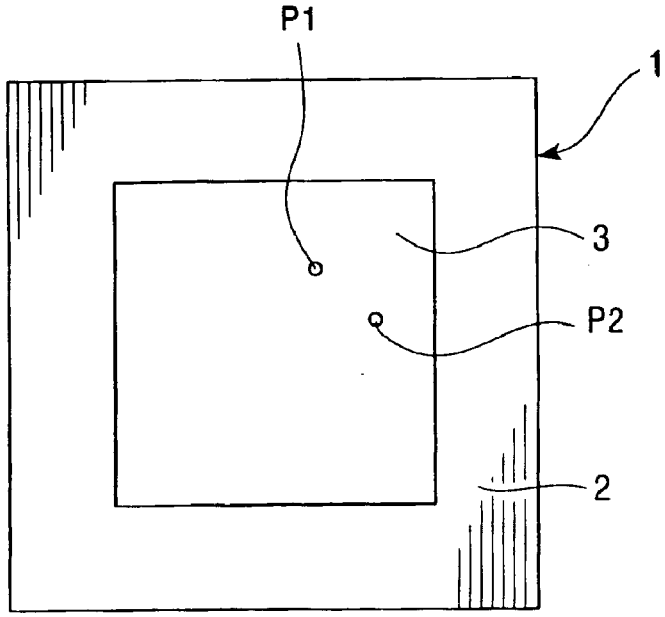
FIG. 4 is a front view of the patch antenna.

As shown in FIGS. 2 and 3, a pair of transmission lines 6*a* and 6*b* of the 90°-phase-difference circuit 6 are connected to a pair of output terminals of the Wilkinson distribution circuit 7, and an input terminal of the Wilkinson distribution circuit 7 is connected to an internal conductor of a coaxial cable 20. The Wilkinson distribution circuit 7 includes a junction 10 whose input side is connected to the coaxial cable 20, two line conductors 11 and 12 connected to an output side of the junction 10, and a resistor 13 for coupling the output sides of the line conductors 11 and 12. Both ends of the resistor 13 are connected between the 90°-phase-difference circuit 6 and the line conductors 11 and 12. The two line conductors 11 and 12 are connected in parallel to each other. When the wavelength of a signal wave on the transmission line is λ, the electric length of each of the line conductors 11 and 12 is set to λ/4. Also, when the input impedance of the Wilkinson distribution circuit 7 is Z1 and the input impedance of the main body 1 is Z2, the characteristic impedance Z3 of each of the line conductors 11 and 12 is defined by the following equation: $Z3=\sqrt{2\times Z1\times Z2}$. The resistance R of the resistor 13 is set to 2×Z2. For example, since the characteristic impedance of the coaxial cable 20 is 50 Ω, the input impedance Z1 of the Wilkinson distribution circuit 7 is 50 Ω. Accordingly, the characteristic impedance Z3 of each of the line conductors 11 and 12 is set to about 70 Ω, and the resistance R of the resistor 13 is set to 100 Ω.

The transmission line 6*a* of the 90°-phase-difference circuit 6 is provided with a line conductor 14 having a characteristic impedance of 50 Ω and an electric length of 0, and the transmission line 6*b* is provided with a line conductor 15 having a characteristic impedance of 50 Ω and an electric length of 0 and a line conductor 16 having a characteristic impedance of 50 Ω and an electric length of λ/4. With this configuration, the phase of a signal supplied to the feeding point P2, which is connected to the transmission line 6*b*, is always delayed by 90° with respect to the phase of a signal supplied to the feeding point P1, which is connected to the transmission line 6*a*.

In the patch antenna configured in the above-described manner, two orthogonal modes of the patch electrode 3 are excited with the phase difference of 90° so as to radiate a circularly polarized radio wave. Since this patch antenna includes two feeding points, a desirable axial ratio characteristic can be obtained over a wide frequency band. Furthermore, in this patch antenna, the Wilkinson distribution circuit 7 is provided between the 90°-phase-difference circuit 6 and the coaxial cable 20. Therefore, even if reflection is occurred at the patch electrode 3, this reflection is absorbed by the resistor 13 of the Wilkinson distribution circuit 7 through the 90°-phase-difference circuit 6, so that the electric power supplied from the coaxial cable 20 is evenly distributed to the transmission lines 6*a* and 6*b* without reflection. Accordingly, reflection of a signal wave can be significantly reduced over a wide frequency band, and thus a favorable reflection characteristic can be obtained over a wide band. In this way, a favorable reflection characteristic as well as a favorable axial ratio characteristic can be obtained in a wider band, and thus the patch antenna according to the embodiment serves as a circularly-polarized-wave antenna which can cover radio waves over a wide frequency band.

Further, since the main body 1 and the circuit board 5 are integrated, a compact and thin patch antenna for a wide band can be obtained, which is highly practical. In the embodiment, the main body 1 and the circuit board 5 are bonded to each other so as to form the antenna. Alternatively, a multilayer substrate including the dielectric substrate 2 and the circuit board 5 may be used. Also, instead of using the two feeding pins 8 and 9, two microstrip lines (not shown) may be connected to the patch electrode 3 for performing feeding. In this configuration, by providing the 90°-phase-difference circuit 6 and the Wilkinson distribution circuit 7 between the microstrip lines and the coaxial cable serving as a feeder line, the patch antenna can be used in a wider band.

The present invention is realized in the above-describe manner, and has the following advantages.

According to the patch antenna of the present invention, a two-point feeding method is used, in which the 90°-phase-difference circuit is connected to the two feeding points of the patch electrode. With this configuration, a favorable axial ratio characteristic can be obtained in a wider band. Also, the Wilkinson distribution circuit is provided between the 90°-phase-difference circuit and the coaxial cable serving as a feeder line so as to improve an isolation characteristic and to obtain a favorable reflection characteristic in a wider band. Accordingly, a compact, thin, and highly practical circularly-polarized-wave antenna which can cover radio waves in a wide bandwidth can be obtained.

What is claimed is:

1. A patch antenna comprising:

a main body including a dielectric substrate in which a patch electrode is provided on one principal surface thereof and a ground electrode is provided on the other principal surface thereof, two feeding points being provided in the patch electrode;

a circuit, positioned below the ground electrode opposite the dielectric substrate, that generates a phase difference of 90° between high-frequency signals supplied to the two feeding points through a pair of output terminals connected to the two feeding points; and a Wilkinson distribution circuit including a pair of output terminals connected to the 90°-phase-difference generating circuit, wherein an input terminal of the Wilkinson distribution circuit is connected to a feeder line so that the main body radiates a circularly polarized radio wave.

2. The patch antenna according to claim 1, wherein the Wilkinson distribution circuit comprises:

a junction;

two parallel-connected line conductors connected to the junction, each line conductor having an electric length of about $\lambda/4$ and a characteristic impedance substantially equal to $\sqrt{2\times Z1\times Z2}$, wherein Z1 is an input impedance of the Wilkinson distribution circuit, Z2 is an input impedance of the main body, and $\lambda$ is a wavelength of the high-frequency signal on a transmission line; and a resistor whose both ends are connected between the 90°-phase-difference generating circuit and the line conductors, the resistance of the resistor being substantially equal to $2\times Z2$.

3. The patch antenna according to claim 2, wherein the input impedance of the Wilkinson distribution circuit is about 50 Ω, the characteristic impedance of each of the line conductors is about 70 Ω, and the resistance of the resistor is about 100 Ω.

4. The patch antenna according to claim 1, wherein the 90°-phase-difference generating circuit and the Wilkinson distribution circuit are provided on a lower surface of a circuit board, which is fixed to a lower surface of the ground electrode of the main body in a laminating manner, upper ends of two feeding pins which extend through the dielectric substrate and the circuit board are connected to the feeding points, and lower ends of the two feeding pins are connected to the output terminals of the 90°-phase-difference generating circuit.

5. The patch antenna according to claim 1, wherein the dielectric substrate is square shaped.

6. The patch antenna according to claim 1, wherein the patch electrode is square shaped.

7. A patch antenna comprising:

a main body including a dielectric substrate in which a patch electrode is provided on one principal surface thereof and a ground electrode is provided on the other principal surface thereof, two feeding points being provided in the patch electrode;

a circuit, positioned below the ground electrode opposite the dielectric substrate, for generating a phase difference of 90° between high-frequency signals supplied to the two feeding points through a pair of output terminals connected to the two feeding points; and a Wilkinson distribution circuit including a pair of output terminals connected to the 90°-phase-difference generating circuit, wherein an input terminal of the Wilkinson distribution circuit is connected to a feeder line so that the main body radiates a circularly polarized radio wave, wherein the Wilkinson distribution circuit comprises a junction; two parallel-connected line conductors connected to the junction, each line conductor having an electric length of about $\lambda/4$ and a characteristic impedance substantially equal to $\sqrt{2\times Z1\times Z2}$, wherein Z1 is an input impedance of the Wilkinson distribution circuit, Z2 is an input impedance of the main body, and $\lambda$ is a wavelength of the high-frequency signal on a transmission line; and a resistor whose both ends are connected between the 90°-phase-difference generating circuit and the line conductors, the resistance of the resistor being substantially equal to $2\times Z2$.

8. The patch antenna according to claim 7, wherein the input impedance of the Wilkinson distribution circuit is about 50 Ω, the characteristic impedance of each of the line conductors is about 70 Ω, and the resistance of the resistor is about 100 Ω.

9. The patch antenna according to claim 7, wherein the 90°-phase-difference generating circuit and the Wilkinson distribution circuit are provided on a lower surface of a circuit board, which is fixed to a lower surface of the ground electrode of the main body in a laminating manner, upper ends of two feeding pins which extend through the dielectric substrate and the circuit board are connected to the feeding points, and lower ends of the two feeding pins are connected to the output terminals of the 90°-phase-difference generating circuit.

10. A patch antenna comprising:

a main body including a dielectric substrate in which a patch electrode is provided on one principal surface thereof and a ground electrode is provided on the other principal surface thereof, two feeding points being provided in the patch electrode;

a circuit, positioned below the ground electrode opposite the dielectric substrate, for generating a phase difference of 90° between high-frequency signals supplied to the two feeding points through a pair of output terminals connected to the two feeding points; and a Wilkinson distribution circuit including a pair of output terminals connected to the 90°-phase-difference generating circuit, wherein an input terminal of the Wilkinson distribution circuit is connected to a feeder line so that the main body radiates a circularly polarized radio wave, wherein the 90°-phase-difference generating circuit and the Wilkinson distribution circuit are provided on a lower surface of a circuit board, which is fixed to a lower surface of the ground electrode of the main body in a laminating manner, upper ends of two feeding pins which extend through the dielectric substrate and the circuit board are connected to the feeding points, and lower ends of the two feeding pins are connected to the output terminals of the 90°-phase-difference generating circuit.

* * * * *